United States Patent [19]

Intini

[11] Patent Number: 4,537,312

[45] Date of Patent: Aug. 27, 1985

[54] CHILD-RESISTANT TAMPER-EVIDENT PACKAGE

[76] Inventor: Thomas D. Intini, 9720 Recollet St., Brossard, Quebec, Canada, J4X 1B9

[21] Appl. No.: 613,334

[22] Filed: May 23, 1984

Related U.S. Application Data

[63] Continuation-in-part of Ser. No. 495,993, May 19, 1983, abandoned.

[51] Int. Cl.[3] ..... B65D 83/04

[52] U.S. Cl. ..... 206/531; 206/532; 206/484; 206/820

[58] Field of Search ..... 206/461, 484, 484.2, 206/530, 531, 532, 534, 601, 820

[56] References Cited

U.S. PATENT DOCUMENTS

| | | | |
|---|---|---|---|
| 3,380,578 | 4/1968 | Sparks | 206/532 |
| 3,835,995 | 9/1974 | Haines | 206/484 |
| 3,899,080 | 8/1975 | Brunda | 206/531 |
| 3,912,081 | 10/1975 | Haines et al. | 206/531 |
| 3,921,805 | 11/1975 | Compere | 206/532 |
| 3,924,746 | 12/1975 | Haines | 206/530 |
| 3,924,747 | 12/1975 | Gerner | 206/531 |
| 4,011,949 | 3/1977 | Braber et al. | 206/484 |
| 4,158,411 | 6/1979 | Hall et al. | 206/531 |
| 4,243,144 | 1/1981 | Margulies | 206/532 |
| 4,280,621 | 7/1981 | Tonrey | 206/484 |

*Primary Examiner*—Joseph Man-Fu Moy
*Assistant Examiner*—David Fidei
*Attorney, Agent, or Firm*—Watson, Cole, Grindle & Watson

[57] ABSTRACT

A child-resistant tamper-evident package is taught wherein the product to be dispensed is enclosed in a blister packet, which in turn is enclosed in further packaging having tabs therein, the packaging child-resistant features while also being tamper-evident.

4 Claims, 10 Drawing Figures

Fig. 4
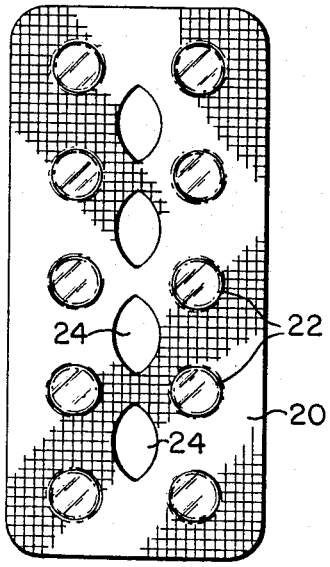
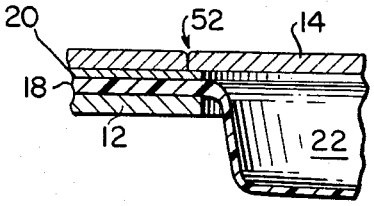
Fig. 5
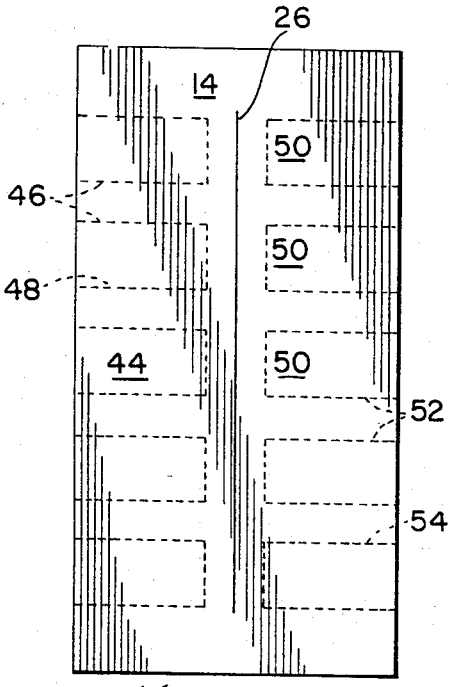
Fig. 6
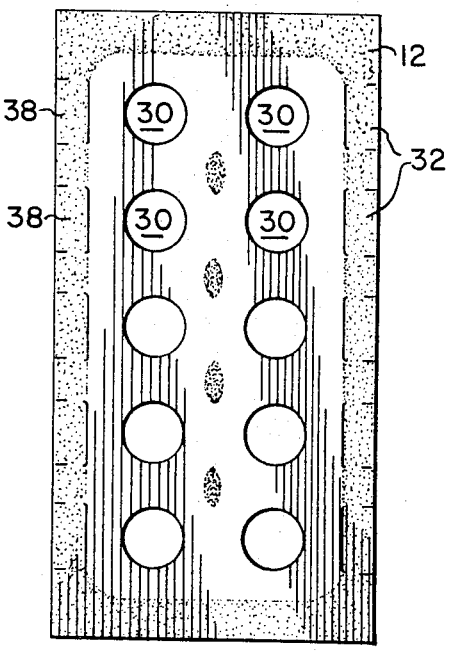
Fig. 7

CHILD-RESISTANT TAMPER-EVIDENT PACKAGE

Continuation-in-part of Ser. No. 495,993, 5-19-83, now abandoned.

The present invention relates to a tamper-evident package and more particularly, relates to a tamper-evident package adapted to contain unit dose capsules, tablets or like products.

The art is replete with tamper-evident packaging wherein a unit article is packaged in a manner such that subsequent to the packaging, access cannot be obtained to the article without leaving a telltale trace. One of the most common fields in which tamper-evident packaging is employed is in the pharmaceutical field although products other than pharmaceuticals have also been packaged in such a manner.

As aforementioned, it is desirable to provide for tamper-evident packaging which will give a clear indication when the contents of the packaging have been tampered with. However, at the same time, the package must be sufficiently easy for the average consumer to open and even more desirable, sufficiently easy for a consumer suffering handicaps to open since the products in the pharmaceutical field are often directed to such people. Still further, it is desirable that the package by child-resistant—i.e. that a child would have a certain degree of difficulty in obtaining access to the product.

In the art, a conventional-type package which is utilized is a laminate which comprises a blister layer having capsule receiving pockets and a foil layer over the back of the blister pack. The foil material is rupturable such that when the blister bubble forming the pocket is pushed, the capsule or other item in the blister pocket will rupture the foil and be ejected for use. While this type of arrangement has been found to be suitable, such a package is not child-resistant.

It is therefore an object of the present invention to provide a tamper-resistant package which, while providing easy access to the end user, has child-resistant features.

According to the present invention, such a package comprises an outer front layer, an outer back layer, and an intermediate laminate between the outer front layer and the outer back layer, the intermediate laminate including a blister layer with at least one capsule-receiving pocket formed therein, a rupturable film adhered to the blister layer with the film overlying said pocket, and at least one aperture formed in the laminate, the front and back layers being sized larger than the intermediate laminate to thereby envelope the laminate, the front and back layers being sealed to each other through the aperture in the laminate, and about their periphery and the outer back layer being sealed to the film, a tab member formed in the front layer, a removable panel formed in the back layer, the removable panel overlying the tab member and at least one of the capsule-receiving pockets, the outer back layer being formed of a material which, when a force is applied to remove the removable panel, the material will delaminate to leave a portion thereof adhering to the film to thereby reinforce the film.

In greater detail, the laminate layer is comprised of a suitable blister packaging layer having at least one capsule-receiving pocket therein. Conventionally, a plurality of such capsule-receiving pockets will be provided for dispensation of unit doses of pharmaceuticals. As is known in the art, this layer may comprise a normally rectangular continuous blister sheet of a flexible clear plastic film having a plurality of capsule-receiving pockets therein. Normally, this blister sheet is made of a clear flexible film which cannot be easily ruptured, such a film typically being a vinyl thermoplastic film normally about 10 mils in thickness.

The backing sheet or rupturable film layer is also well-known in the art; this rupturable layer is co-extensive with the blister sheet and covers the capsule-receiving pockets so as to close the pockets and the capsules or products contained therein. A conventional material utilized is aluminum foil approximately 1 mil. in thickness. The sheet is secured to the blister sheet by normal adhesive means.

The present invention contemplates the use of at least one aperture cut through the rupturable sheet and the blister sheet for reasons which will become apparent hereinafter. The number of apertures will depend on the number of unit doses or pockets; in one embodiment, each pocket is at least partially separated from an adjacent pocket by an aperture, again for reasons which will become apparent hereinafter.

The laminate is normally completely enclosed in an envelope which comprises an outer front layer and an outer back layer; the outer front layer being designated as that layer which fits over the blister bubbles forming capsule-receiving pockets and the outer back layer being designated as that layer which lies adjacent to the rupturable film. In the practice of the present invention, the front and back layers are secured to each other about their periphery and they are also secured through the apertures provided in the laminate. Accordingly, the outer front layer and outer back layer are sized to be larger than the laminate such that they may envelope the same.

As will be appreciated by those knowledgeable in the art, the outer front layer and outer back layer may be secured to each other by any suitable number of means, including the application of adhesives and the like. However, in a first embodiment, the outer front layer and the outer back layer may be formed of material which, when subjected to a certain operation, will seal together while the laminate is formed of other materials which will not adhere to the outer front layer and outer back layer when subjected to such an operation. In this aspect of the invention, the outer front layers and outer back layers may be formed of materials which are heat sealable together and which are not heat-sealed to the laminate material during the heat-sealing operation. Typically, one may utilize polycoated cardboard for the outer layers, which material will seal to itself.

In a second preferred aspect of the invention, the outer front layer does not adhere to the blister layer, but the outer layer is adapted to adhere to the rupturable film for reasons which will become apparent hereinafter. In particular, the outer back layer is adapted to adhere to the rupturable film with a strength sufficient that the outer back layer cannot readily be peeled from the film, but rather a delamination of the outer back layer will occur.

The outer front layer has, naturally, a plurality of cutouts or apertures formed therein to allow for the protrusion of the blister bubbles therethrough during assembly of the package. These apertures are sized to receive the blister pocket.

The front outer layer also has formed therein a tab member, the tab member being an integral part of the layer and is preferably partially die cut along the periphery thereof. As previously mentioned, the outer front layer and outer back layer are sized larger than the laminate and thus present a margin around the periphery which is sealed together. The tab member is formed within this margin area and preferably, extends from the periphery of the outer front layer to the inner extent of the margin—i.e. where the laminate begins. The tab member may be of any conventional shape, but in a preferred aspect of the invention, it is of a rectangular configuration for reasons to be discussed hereinbelow.

The outer back layer has formed therein at least one removable panel. This panel is defined by a plurality of die cuts or perforations in a conventional manner. This panel is co-extensive with the portion of the outer back layer which overlies at least one of the capsule receiving pockets and is also co-extensive with one of the tab members formed in the outer front layer.

In operation of the first embodiment, the removable panel is removed in conjunction with the use of the tab member of the outer front layer to expose the foil layer of the laminate. The individual product may then be removed in a conventional manner through rupture of the foil layer.

In the second embodiment, wherein the outer back is adhered to the rupturable film, a force applied to the tab member to remove the removable panel will cause a delamination of the outer back layer. Thus, a portion of the outer back layer is left adhered to the rupturable film to thereby reinforce the same. In this embodiment, it is to be found that this increases the strength of the rupturable film and renders the package more child resistant since even if the child did manage to remove the removable panel, sufficient force would be required to push the contents of the pocket through the rupturable film and adhered backing so as to prevent most children from accomplishing the same.

The tab member, as will be discussed in the preferred embodiments, requires a tearing force applied thereto before it can readily be detached to remove the removable panel. This provides a further safeguard against a small child accidentally gaining access to the contents of the package.

The above package provides tamper-evident advantages while at the same time, is easily openable. The features of the die cutting, at the same time, prevent easy access by the young child to the package, as will be discussed in the detailed description of the embodiments.

Naturally, the package can take many different forms such as calendar packs, etc., using various indicia and the like as is conventional in the art.

Having thus generally described the invention, reference will be made to the accompanying drawings illustrating embodiments thereof, in which:

FIG. 4 is a bottom plan view of the intermediate foil layer;

FIG. 5 is a detail sectional view of a portion of a pocket;

FIG. 6 is a bottom plan view of the outer back layer of the package;

FIG. 7 is a top plan view of the outer front layer;

Figure 1:
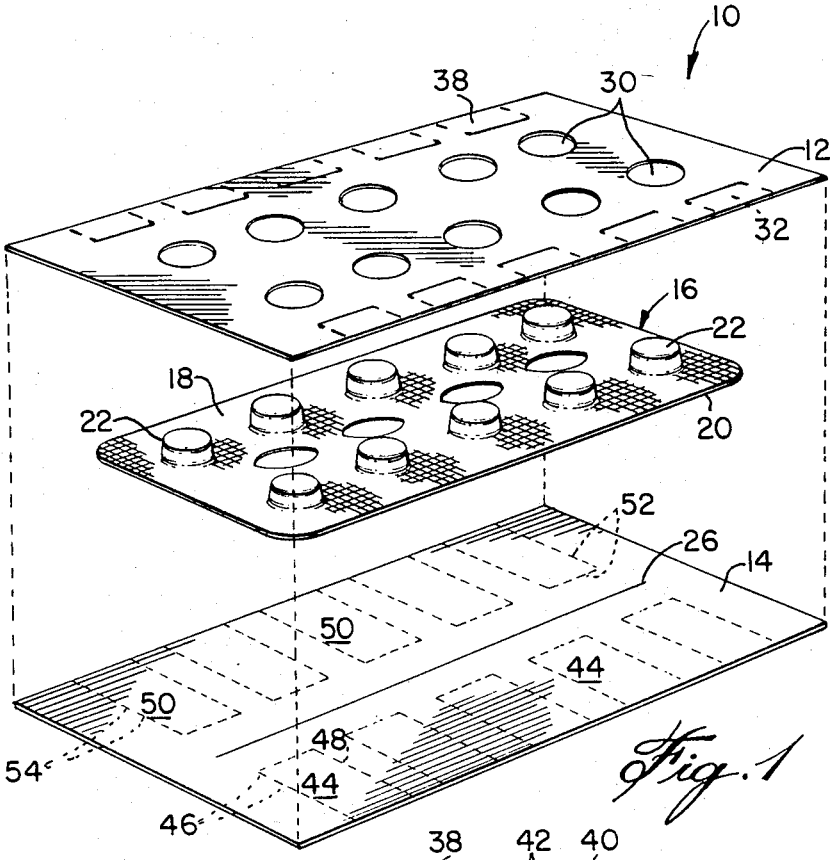
FIG. 1 is a perspective view of the package illustrating the components thereof.
Figure 2:
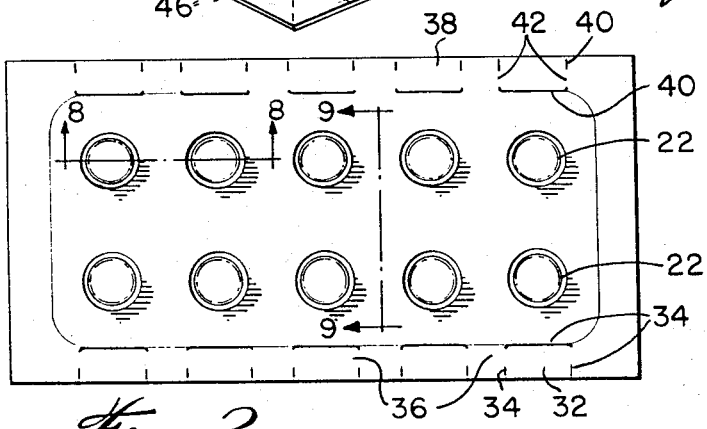
FIG. 2 is a top elevational view thereof.
Figure 3:
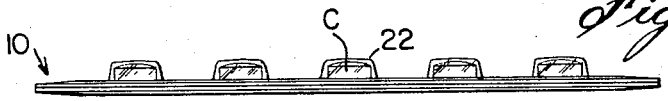
FIG. 3 is a side elevational view thereof.
Figure 8:
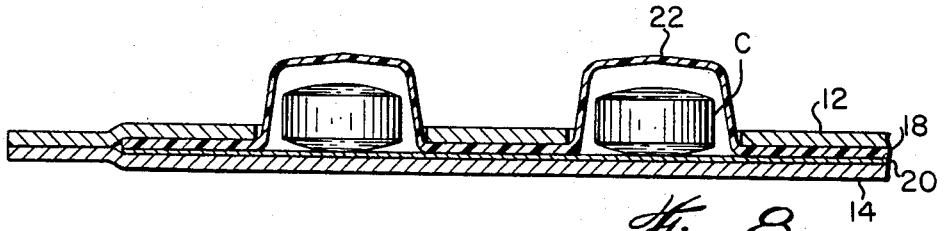
FIG. 8 is a cross-sectional view taken along the lines 8—8 of FIG. 2.
Figure 9:
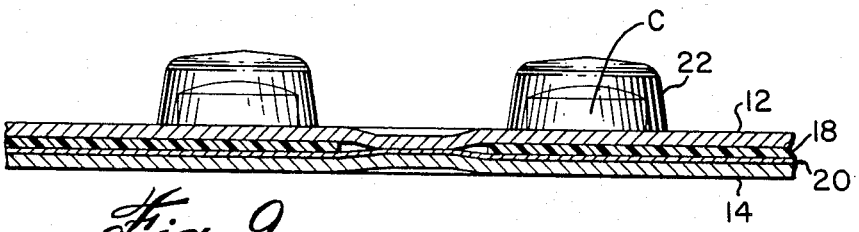
FIG. 9 is a cross-sectional view taken along the lines 9—9 of FIG. 2.

Referring to the drawings in greater detail and by reference characters thereto, there is shown in FIG. 1 a partially disassembled package generally designated by reference numeral 10.

Package 10 is comprised of an outer front layer 12 and an outer back layer 14 which together define an enclosure for an inner capsule-containing laminate 16. As will be discussed in greater detail hereinbelow, outer front layer 12 and outer back layer 14 may be formed of a single integral member with a fold line or of separate pieces.

Capsule-containing laminate 16 is formed of a blister pack layer generally designated by reference numeral 18. Blister pack layer has a plurality of bubbles or capsule-receiving pockets 22 therein adapted to receive capsules generally designated by reference character C. To the back of blister pack layer 18 is adhered a thin backing film 20, which film 20 is rupturable under pressure.

The use of a blister pack layer 18 with associated backing 20 to thereby encapsulate capsules C in pockets 22 is, per se, well known in the art. The use of the two layers completely encloses the capsules and yet, through a suitable choice of materials, permits the removal of the capsule by rupture of the backing layer 20. Thus, pressure may be put with a finger on bubbles 22 to force capsule C to rupture layer 20 to permit removal of the capsules. In practice, backing layer 20 is formed of a thin foil material.

As will be seen in FIGS. 1 and 4, blister pack layer 18 and backing layer 20 both have a plurality of apertures generally designated by reference numeral 24 formed therein.

Referring to FIG. 7, it will be seen that outer front layer 12 has a plurality of cutouts 30 therein, which cutouts 30 are sized according to the dimensions of capsule receiving pockets 22 such that in assembly, capsule receiving pockets 22 will protrude through cutouts 30 as may be seen in FIG. 1. Outer front layer 12 also has a plurality of first tab sections 32 extending along one edge thereof, each tab section 32 corresponding to a cutout 30. On a second opposed edge there are provided a plurality of second tab sections 38 again each tab section 38 corresponding to a cutout 30 which is adapted to have a capsule receiving pocket or blister 22 extend therethrough.

In greater detail, each tab section 32 is defined by die cuts 34 with uncut portions 36 therebetween. The cutting of die cuts 34 is conventional except as hereinafter described. Similarly, tab sections 38 have die cuts 40 with uncut portions 42 therebetween.

In die cutting tabs 32 and 38, which are of a rectangular configuration, die cuts 34 and 40 are done such that an effort is required to commence tearing of the tab portion and the removable panel secured thereto. To this end, as may be seen in the drawings, the first die cut is made proximate the outer marginal edge of outer front layer 12 and a substantial space 36 is left uncut to the next die cut which is substantially perpendicular to the first one. Thus, a thorough resistance is provided to tear initiation and this provides a greater security against children being able to open the package.

Outer back layer 14 has a first set of removable panels or sections 44 adapted to act in conjunction with first tab sections 32 and a second set of tear sections 50 adapted to act in conjunction with tabs 38 as will become apparent hereinbelow. As was the case with the tab sections, removable panel 44 is defined by a plurality of die cuts 46 and integral portions 48; panels 50 similarly have die cuts 52 and integral portions 54.

In assembly, and as previously mentioned, blister pack layer has secured thereto a backing layer 20 and apertures 24 are then formed in both layers 18 and 20. Outer front layer 12 and outer back layer 14 are then placed about laminate 16 and subjected to a sealing operation.

The choice of materials and the sealing operation requires that outer front layer 12 and outer back layer 14 be sealable to each other while outer back layer 14 is also sealed to film 20. The overlapping portion or margin contains the tabs 32 and 38; preferably, the tabs 32 and 38 are sized to extend inwardly to the periphery of laminate 16.

As will be seen from the drawings, laminate layer 16 is sized to be smaller than outer front layer 12 and outer back layer 14 such that layers 12 and 14 may be sealed together to form an envelope about laminate 16.

As aforementioned, layers 12 and 14 are sealable to each other and will seal along the four edges thereof and also through apertures 24. Also, it will be noted that removable panels 44 and 50 are in registry with tab sections 38 and 32 respectively when outer back layer 14 is folded about fold line 15 to be secured to outer front layer 12.

Figure 10:
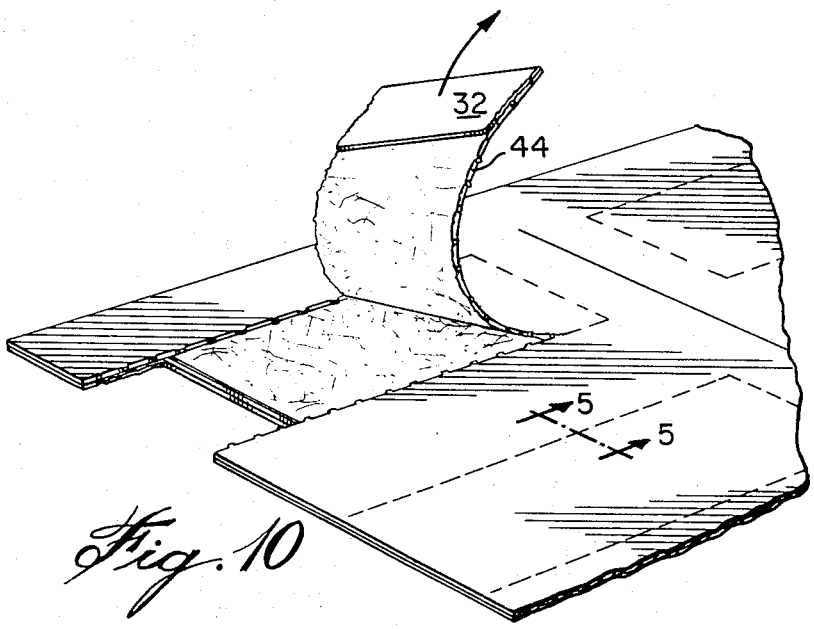
FIG. 10 is a partial view, in perspective, of a capsule-containing area illustrating removal of the tab and removable panel.

As a result of the above, there is obtained a child-resistant, tamper-evident package having substantial advantages. Access to the capsules C within capsule receiving pockets 22 may be had by grasping tab section 32 and tearing back along to remove panel 44. As previously mentioned, outer back layer 14 is adhered to film 20 and is formed of a material which can be delaminated such as cardboard. As a result of the secure adhesion of outer back layer 14 to film 20, the material forming panel 44 delaminates as illustrated in FIG. 10. Thus, a portion of the material forming outer back layer 14 remains adhered to film 20 thus requiring a greater force to expel capsule C from its pocket. This force can readily be achieved by an adult, but not by a child. Furthermore, a solid die cut line 26 extends between panels 44 and 50 to thereby prevent removal of one panel extending into removal of a second panel.

Although not shown in the drawings, conventional markings and indicia may be provided on the package. Thus, the package may be arranged as a calendar pack as is known in the art.

It will also be appreciated that changes and modifications may be made to the above described embodiments without departing from the spirit and scope of the invention. Thus, the particular configuration of the rmovable panels may be modified without any essential changes to the invention. Similarly, the particular configuration of apertures 24 may be modified. Still further, the package may be arranged in various configurations. In one particularly advantageous arrangement, a plurality of packages such as illustrated in FIG. 1 may be provided with the packages being joined by webs of material at either extremity such that the individual packages may be folded one over on top of another. Cut lines may be provided to enable one to detach a package from a further one.

I claim:

1. A child-resistant tamper evident package comprising an outer front layer and an outer back layer, an intermediate laminate between the outer front layer and outer back layer, said intermediate laminate including a blister layer having at least one capsule-receiving pocket formed therein, a rupturable film adhered to the blister layer with the film overlying said pocket, at least one aperture formed in said laminate, said front and back layers being sized larger than the intermediate laminate to thereby envelope the laminate, the front and back layers being sealed to each other about their periphery and to the aperture in said laminate, said outer back layer also being sealed to said film, a tab member formed in said outer front layer, a removable panel formed in said outer back layer, the removable panel overlying the tab member and at least one of the capsule-receiving pockets, said outer back layer being formed of a material which, when a force is applied thereto, sufficient to remove the removable panel, the material will delaminate to leave a portion thereof adhering to the film to thereby reinforce said film.

2. The package of claim 1 wherein each of said tab members is sized to extend inwardly from a margin of said outer front layer to the margin of said laminate.

3. The package of claim 2 wherein said tab members are die cut to have a rectangular configuration, said die cuts being arranged such that there is provided a substantial resistance to tear initiation of said tabs.

4. The package of claim 1 wherein said film overlying said blister layer is a rupturable film formed of a foil material.

* * * * *